US007429202B2

(12) United States Patent
Yazaki et al.

(10) Patent No.: US 7,429,202 B2
(45) Date of Patent: Sep. 30, 2008

(54) OUTBOARD MOTOR CONTROL SYSTEM

(75) Inventors: Makoto Yazaki, Wako (JP); Shinsaku Nakayama, Wako (JP); Hideaki Takada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/274,862

(22) Filed: Nov. 15, 2005

(65) Prior Publication Data

US 2006/0105647 A1 May 18, 2006

(30) Foreign Application Priority Data

Nov. 16, 2004 (JP) ..... 2004-332327

(51) Int. Cl.
*B63H 5/20* (2006.01)
*B63H 25/04* (2006.01)

(52) U.S. Cl. ..... 440/53; 114/144 R

(58) Field of Classification Search ..... 114/144 R; 440/53, 1, 84
See application file for complete search history.

(56) References Cited

U.S. PATENT DOCUMENTS 3,800,128 A * 3/1974 Kurk ..... 701/21
6,032,087 A * 2/2000 Yamamoto ..... 701/21
6,234,853 B1 * 5/2001 Lanyi et al. ..... 440/53
6,994,046 B2 * 2/2006 Kaji et al. ..... 114/144 R
7,121,908 B2 * 10/2006 Okuyama ..... 440/84
2005/0199167 A1 * 9/2005 Mizutani ..... 114/144 R
2005/0282447 A1 * 12/2005 Okuyama ..... 440/53

FOREIGN PATENT DOCUMENTS

JP 8276896 10/1996

* cited by examiner

*Primary Examiner*—Lars A Olson
*Assistant Examiner*—Daniel V Venne
(74) *Attorney, Agent, or Firm*—Carrier, Blackman & Associates, P.C.; Joseph P. Carrier; William D. Blackman

(57) ABSTRACT

In an outboard motor control system having two outboard motors each mounted on a stern of a boat, there is provided a controller that controls operation of steering actuators to regulate steering angles of the outboard motors such that lines extending from axes of rotation of the propellers of the outboard motors intersect at a desired point. With this, it becomes possible to freely adjust the stream confluence point of the outboard motors, thereby improving boat driving stability and providing enhanced auto-spanker performance.

4 Claims, 8 Drawing Sheets

OUTBOARD MOTOR CONTROL SYSTEM

BACKGROUND OF THE INVENTION

1. Field of the Invention

This invention relates to an outboard motor control system, particularly to an outboard motor control system for controlling the operation of a plurality of outboard motors mounted on a boat (hull).

2. Description of the Related Art

When two or more outboard motors are mounted on the stern of a boat (hull) in what is known as a multiple outboard motor installation, the outboard motors are usually connected by a link called tie bar for enabling mechanically interconnected steering of the outboard motors, as taught in Laid-Open Patent Application No. Hei 8(1996)-276896, for example.

In the case of multiple outboard motor installation, boat driving stability can be improved by making extensions of the outboard motors' propeller axes of rotation intersect at a predetermined distance (e.g., about 20 meters) rearward of the mounting location of the outboard motors. (In the following, the point of intersection of the extensions of the outboard motors' propeller axes of rotation will sometimes be called the "stream confluence point.") In the prior art, therefore, the practice has been to adjust the length and the like of the tie bar interconnecting the outboard motors so as to align the outboard motors at predetermined angles relative to one another.

In addition, a so-called auto-spanker has been developed for individually regulating thrust of the outboard motors of a multiple motor installation so as to automatically maintain the bow direction and position of the boat constant. This is accomplished by detecting the speed and direction of the wind hitting the boat and regulating the shift (gear) position and throttle opening of the outboard motors based on the detected values in order to adjust the direction and magnitude of outboard motor thrust for maintaining the bow direction constant (usually windward) and the keeping the boat stationary.

When multiple outboard motors are mechanically connected by the tie bar as in the prior art, the angles between the outboard motors change with steering of the outboard motors. Because of this, as shown in FIG. 8, the stream confluence point can be made to fall at or approximately at the desired point only when the steering angles of the outboard motors fall within a certain range. Room for improvement in boat driving stability therefore remains.

In addition, it is known that boat turning performance can be regulated by adjusting the stream confluence point. Adjustment of the stream confluence point is therefore effective for regulating the bow direction and position of a boat using an auto-spanker. However, when the angle between the outboard motors is rigidly fixed by the tie bar in the conventional manner, the stream confluence point cannot be freely changed, so that the perfonnanee of the prior art auto-spanker is not satisfactory.

SUMMARY OF THE INVENTION

An object of this invention is therefore to solve the foregoing issues and to provide an outboard motor control system that enables free adjustment of the stream confluence point of multiple outboard motors installed on a boat, thereby improving boat driving stability and providing enhanced auto-spanker performance.

In order to achieve the object, this invention provides in a first aspect a system for controlling operation of a plurality of outboard motors each adapted to be supported on a stem of a boat by a shaft to be steerable relative to the boat and each having a propeller and a steering actuator driving the shaft, comprising: a controller controlling operation of the steering actuators to regulate steering angles of the outboard motors such that lines extending from axes of rotation of the propellers of the outboard motors intersect at a desired point.

In order to achieve the object, this invention provides in a second aspect a system for controlling operation of a plurality of outboard motors each adapted to be supported on a stern of a boat by a shaft to be steerable relative to the boat and each having a propeller and a steering actuator driving the shaft, comprising: a plurality of controllers each controlling operation of an associated one of steering actuators to regulate steering angles of the outboard motors such that lines extending from axes of rotation of the propellers of the outboard motors intersect at a desired point.

BRIEF DESCRIPTION OF THE DRAWINGS

The above and other objects and advantages of the invention will be more apparent from the following description and drawings in which:

in FIG. 1;

DETAILED DESCRIPTION OF THE PREFERRED EMBODIMENTS

Embodiments of an outboard motor control system according to the present invention will now be explained with reference to the attached drawings.

Figure 1:
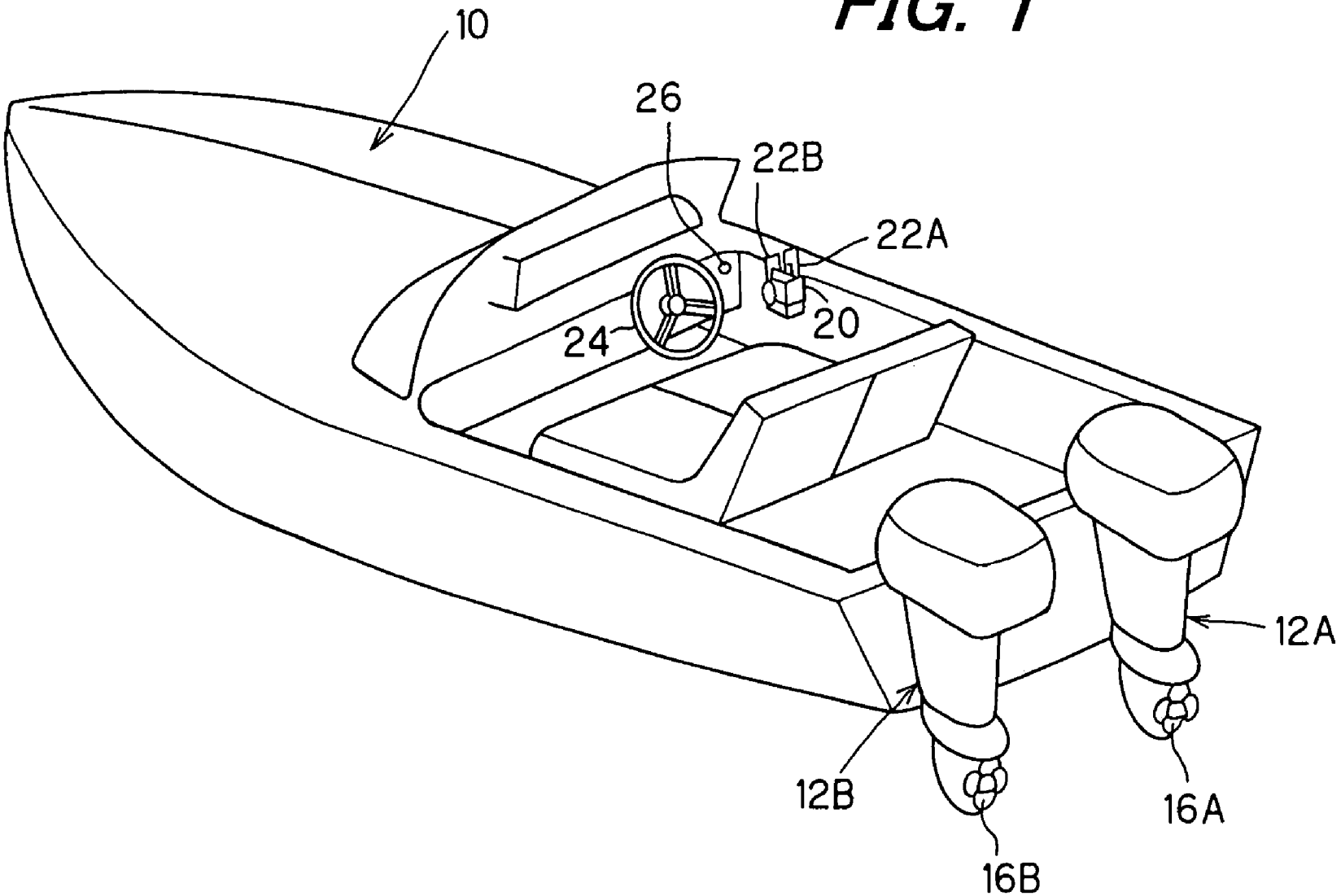
FIG. 1 is an overall schematic view of a boat (hull) and outboard motors equipped with an outboard motor control system according to a first embodiment of this invention.

FIG. 1 is an overall schematic view of a boat (hull) and outboard motors equipped with an outboard motor control system according to a first embodiment of this invention.

As shown in FIG. 1, a plurality of (two) outboard motors are mounted on the stern of a boat (hull) 10. In other words, the boat 10 has what is known as a multiple (dual) outboard motor installation. In the following, the starboard side outboard motor, i.e., outboard motor on the right side when looking in the direction of forward travel is called the "first outboard motor" and assigned the reference symbol 12A. The port side outboard motor, i.e., outboard motor on the left side when looking in the direction of forward travel is called the "second outboard motor" and assigned the reference symbol 12B.

The first and second outboard motors 12A, 12B are equipped at their lower ends in the gravitational direction with propellers 16A, 16B and at their upper ends with internal combustion engines. The propellers 16A, 16B are rotated by power transmitted from the engines and produce thrust for propelling the boat 10.

A remote control box 20 is installed near the cockpit of the boat 10. The remote control box 20 is equipped with two levers to be manipulated by the operator. In the following, the lever provided on the right side as viewed facing in the direction of forward motion is called the "first lever" and assigned the reference symbol 22A. The lever provided on the left side as viewed facing in the direction of forward motion is called the "second lever" and assigned the reference symbol 22B.

The first lever 22A can be rotated fore and aft (toward and away from the operator) from its initial position, by which the operator can input the first outboard motor 12A shift (gear) position commands and engine speed regulation commands. Similarly, the second lever 22B can be moved fore and aft from its initial position, by which the operator can input the second outboard motor 12B shift position commands and engine speed regulation commands.

A steering wheel 24 and an auto-spanker switch 26 are also installed near the cockpit. The operator can rotate the steering wheel 24 to input steering or turning commands and can operate the auto-spanker switch 26. The auto-spanker switch 26 outputs signals for effecting auto-spanker control (control for automatically maintaining the bow direction and position of the boat 10 constant; explained later).

Figure 2:
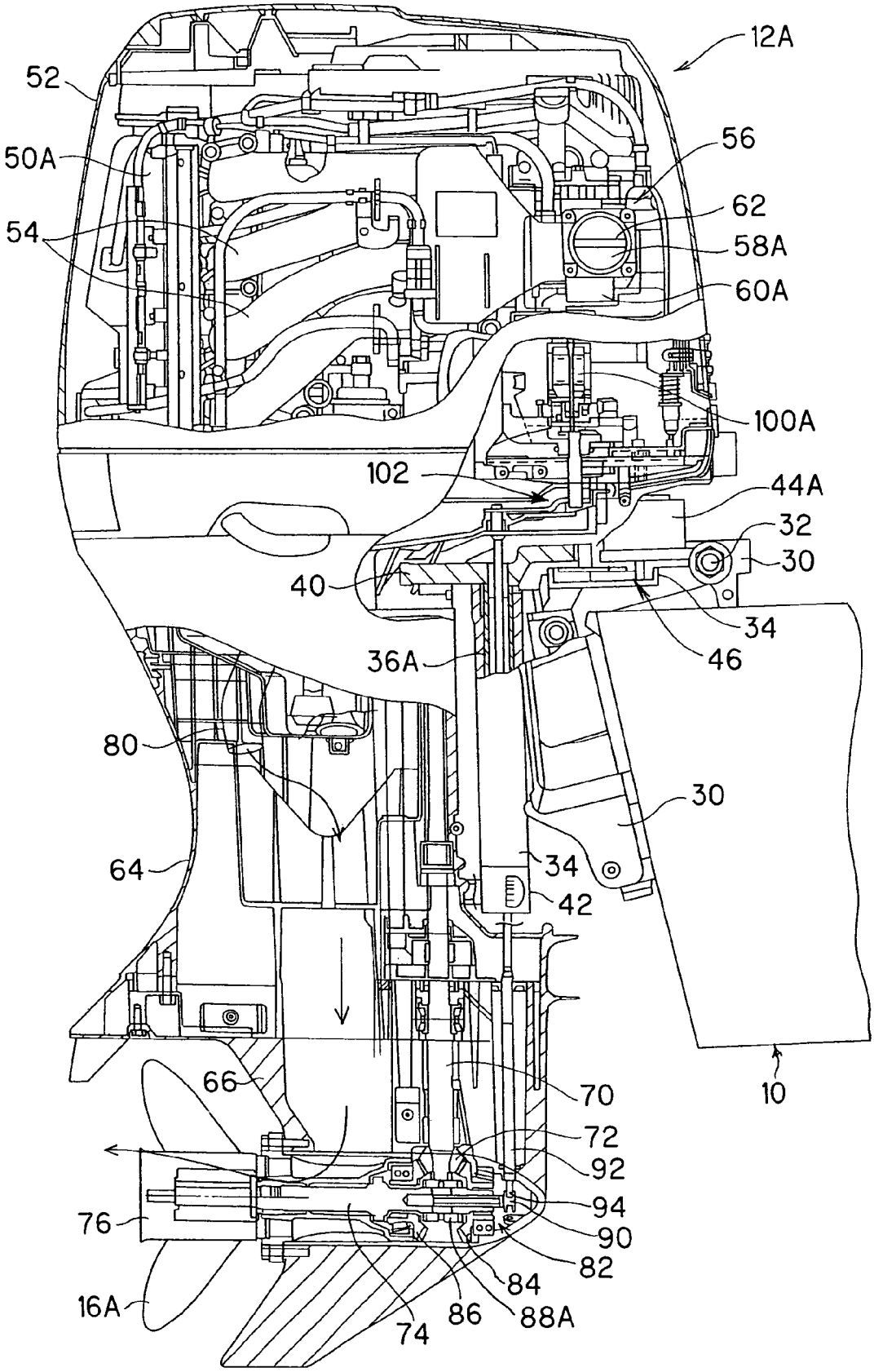
FIG. 2 is an enlarged sectional side view showing a part of a first outboard motor shown.

FIG. 2 is an enlarged sectional side view showing a part of the first outboard motor 12A shown in FIG. 1. The first outboard motor 12A will be explained with reference to FIG. 2.

As shown in FIG. 2, the first outboard motor 12A is equipped with stern brackets 30 fastened to the stern of the boat 10. A swivel case 34 is attached to the stern brackets 30 through a tilting shaft 32.

A swivel shaft (steering shaft) 36A is housed in the swivel case 34 to be freely rotated about a vertical axis. The upper end and lower end of the swivel shaft 36A are fastened, through a mount frame 40 and a lower mount center housing 42 respectively, to a frame constituting a main body of the first outboard motor 12A. Specifically, the first outboard motor 12A having the propeller 16A is supported by the swivel shaft 36A to be freely steered with respect to the boat 10.

The upper portion of the swivel case 34 is installed with an electric steering motor (steering actuator) 44A that drives the swivel shaft 36A. The output shaft of the steering motor 44A is connected to the mount frame 40 via a speed reduction gear mechanism 46. Specifically, a rotational output generated by driving the steering motor 44A is transmitted via the speed reduction gear mechanism 46 to the mount frame 40 such that the first outboard motor 12A is steered about the swivel shaft 36A as a rotational axis to the right and left directions (i.e., steered about the vertical axis).

As described in the foregoing, the first outboard motor 12A is equipped with the engine (now assigned with symbol 50A) at its upper portion. The engine 50A comprises a spark-ignition gasoline engine with a displacement of 2,200 cc. The engine 50A is located above the water surface and covered by an engine cover 52.

The engine 50A has an intake pipe 54 that is connected to a throttle body 56. The throttle body 56 has a throttle valve 58A installed therein and an electric throttle motor (throttle actuator) 60A is integrally disposed thereto. The output shaft of the throttle motor 60A is connected via a speed reduction gear mechanism (not shown) installed near the throttle body 56 with a throttle shaft 62 that rotatably supports the throttle valve 58A. Specifically, a rotational output generated by driving the throttle motor 60A is transmitted to the throttle shaft 62 to open and close the throttle valve 58A, thereby regulating air sucked in the engine 50A to control the engine speed.

An extension case 64 is installed at the lower portion of the engine cover 52 that covers the engine 50A and a gear case 66 is installed at the lower portion of the extension case 64. A drive shaft (vertical shaft) 70 is supported in the extension case 64 and gear case 66 to be freely rotated about the vertical axis. One end, i.e., the upper end of the drive shaft 70 is connected to the crankshaft (not shown) of the engine 50A and the other end, i.e., the lower end thereof is equipped with a pinion gear 72.

A propeller shaft 74 is supported in the gear case 66 to be freely rotated about the horizontal axis. One end of the propeller shaft 74 extends from the gear case 66 toward the rear of the first outboard motor 12A and the propeller 16A is attached thereto, i.e., the one end of the propeller shaft 74, via a boss portion 76.

As indicated by the arrows in FIG. 2, the exhaust gas (combusted gas) emitted from the engine 50A is discharged from an exhaust pipe 80 into the extension case 64. The exhaust gas discharged into the extension case 64 further passes through the interior of the gear case 66 and the interior of the propeller boss portion 76 to be discharged into the water to the rear of the propeller 16A.

A shift mechanism 82 is also housed in the gear case 66. The shift mechanism 82 comprises a forward bevel gear 84, a reverse bevel gear 86, a shift clutch 88A, a shift slider 90 and a shift rod 92.

The forward bevel gear 84 and reverse bevel gear 86 are disposed onto the outer periphery of the propeller shaft 76 to be rotatable in opposite directions by engagement with the pinion gear 72. The shift clutch 88A is installed between the forward bevel gear 84 and reverse bevel gear 86 and rotates integrally with the propeller shaft 76.

The shift rod 92 penetrates in the first outboard motor 12A. Specifically, the shift rod 92 is supported to be freely rotated about the vertical axis in a space from the engine cover 52, passing through the swivel case 34 (more specifically the interior of the swivel shaft 36A accommodated therein), to the gear case 66. The shift clutch 88A is connected via the shift slider 90 to a rod pin 94 disposed on the bottom of the shift rod 92.

The rod pin 94 is formed at a location offset from the center of the bottom of the shift rod 92 by a predetermined distance. As a result, rotation of the shift rod 92 causes the rod pin 94 to move while describing an arcuate locus whose radius is the predetermined distance (offset amount).

The movement of the rod pin 94 is transferred through the shift slider 90 to the shift clutch 88A as displacement parallel to the axial direction of the propeller shaft 74. As a result, the shift clutch 88A is slid to a position where it engages one or the other of the forward bevel gear 84 and reverse bevel gear 86 or to a position where it engages neither of them.

When the shift clutch 88A is engaged with the forward bevel gear 84, the rotation of the drive shaft 70 (output of the engine 50A) is transmitted through the pinion gear 74, forward bevel gear 84, shift clutch 88A and propeller shaft 74 to the propeller 16A, thereby rotating the propeller 16A to produce thrust in the direction of propelling the boat 10 forward. Thus the forward shift position is established.

When the shift clutch 88A is engaged with the reverse bevel gear 86, the rotation of the drive shaft 70 is transmitted through the pinion gear 74, reverse bevel gear 86, shift clutch 88A and propeller shaft 74 to the propeller 16A, thereby rotating the propeller 16A in the direction opposite from that during forward travel to produce thrust in the direction of propelling the boat 10 rearward. Thus the reverse shift position is established.

When the shift clutch 88A is not engaged with either the forward bevel gear 84 or the reverse bevel gear 86, the rotation of the drive shaft 70 is not transmitted to the propeller 16A. Thus the neutral shift position is established.

The interior of the engine cover 52 is disposed with an electric shift motor (shift actuator) 100A that drives the shift clutch 88A to change a shift position.

The output shaft of the shift motor 100A is connected to the upper end of the shift rod 92 through a speed reduction gear mechanism 102. Therefore, when the shift motor 100A is driven, its rotational output is transmitted to the shift rod 92 through the speed reduction gear mechanism 102, thereby rotating the shift rod 92. The rotation of the shift rod 92 drives (slides) the shift clutch 88A to conduct a shift change.

It should be noted that, since the configurations of the first outboard motor 12A and second outboard motor 12B are the same, the explanation made with reference to FIG. 2 is also applied to the second outboard motor 12B. When indicating a member of the second outboard motor 12B in the following explanation, "B" will be assigned instead of "A" that is appended to the reference numerals of the members already explained with FIG. 2.

Based on the foregoing explanation, the block diagram of FIG. 3 will now be explained.

Figure 3:
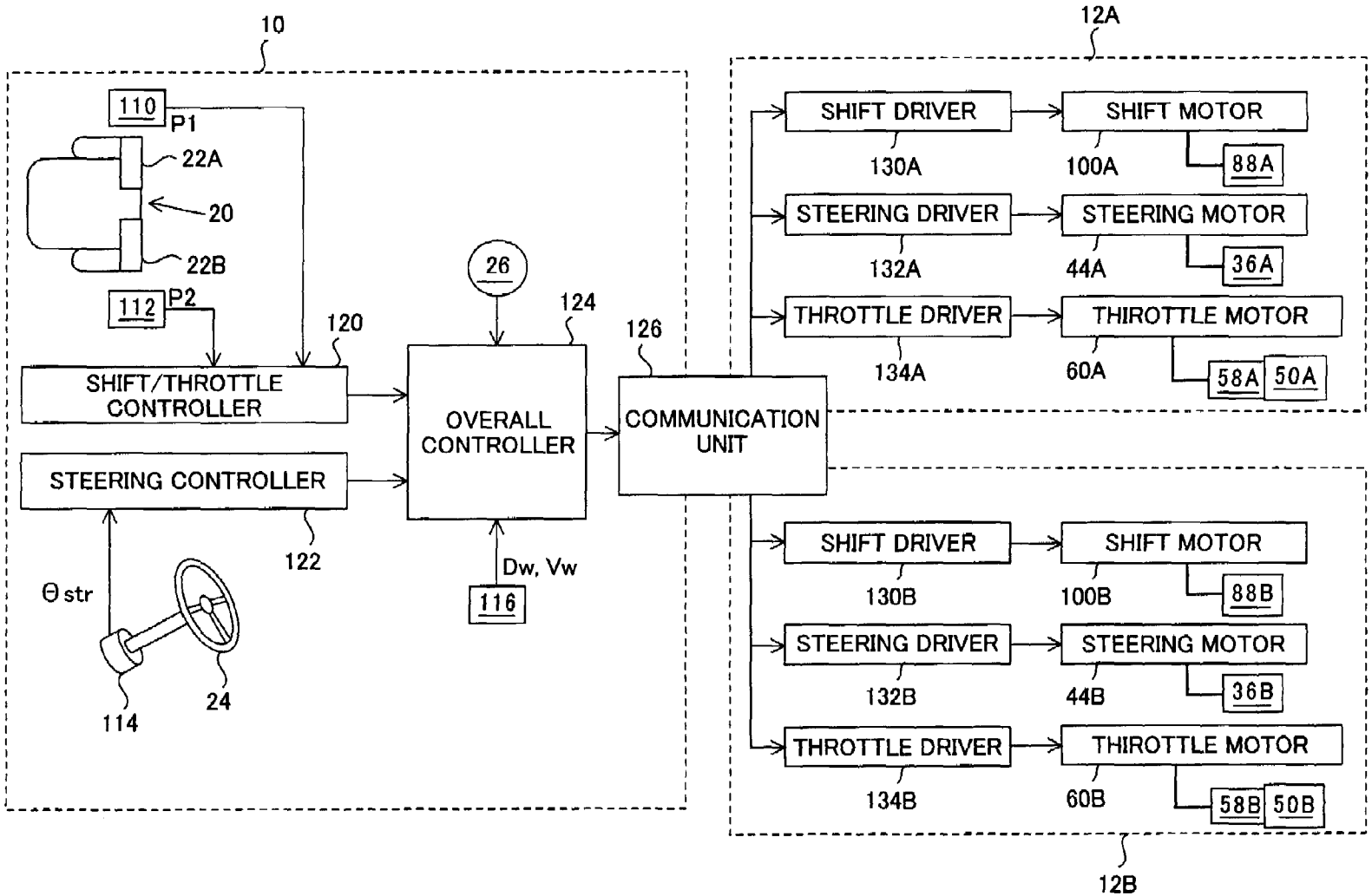
FIG. 3 is a block diagram showing the outboard motor control system according to the first embodiment in detail.

As shown in FIG. 3, a first lever position sensor 110 is provided near the first lever 22A of the remote control box 20 installed on the boat 10. The first lever position sensor 110 produces an output or signal corresponding to the position P1 to which the first lever 22A is manipulated by the operator. Further, a second lever position sensor 112 is provided near the second lever 22B of the remote control box 20. The second lever position sensor 112 produces an output or signal corresponding to the position P2 to which the second lever 22B is moved by the operator.

A rotation sensor 114 is provided on the rotating shaft of the steering wheel 24. The rotation sensor 114 produces an output or signal proportional to the rotation angle θstr to which the operator rotates the steering wheel 24. An anemometer or anemovane 116 is installed at a suitable location on the boat 10. The anemometer 116 outputs a signal proportional to the direction Dw and speed Vw of the wind hitting the boat 10. A shift/throttle controller 120, steering controller 122 and overall controller 124 are installed at suitable locations on the boat 10.

The outputs P1 and P2 of the first lever position sensor 110 and second lever position sensor 112 are sent to the shift/throttle controller 120. The shift/throttle controller 120, which comprises a microcomputer including input and output circuits, a CPU and the like (none of which are shown), determines command values for the shift motor 100A and throttle motor 60A of the first outboard motor 12A based on the output P1 of the first lever position sensor 110 and uses the output P2 of the second lever position sensor 112 to determine command values for the shift motor 100B and throttle motor 60B of the second outboard motor 12B.

Specifically, the shift/throttle controller 120 determines command values for the shift motors 100A, 100B (i.e., determines the shift positions) based on the direction of movement of the levers 22A, 22B detected by the lever position sensors 110, 112 and determines command values for the throttle motors 60A, 60B (i.e., determines the openings of the throttle valves 58A, 58B) based on the amount of movement of the levers 22A, 22B.

The output θstr of the rotation sensor 114 is sent to the steering controller 122. The steering controller 122, which is constituted as a microcomputer comprising input and output circuits, a CPU and the like (none of which are shown), determines command values for the steering motor 44A of the first outboard motor 12A and the steering motor 44B of the second outboard motor 12B (i.e., determines steering angles for the outboard motors 12A, 12B), based on the output θstr of the rotation sensor 114.

The command values for the shift motors 100A, 100B and command values for the throttle motors 60A, 60B determined by the shift/throttle controller 120, and the command values for the steering motors 44A, 44B determined by the steering controller 122 are inputted to the overall controller 124. The outputs Dw, Vw of the anemometer 116 and the output of the auto-spanker switch 26 are also inputted to the overall controller 124. The overall controller 124 comprises a microcomputer having input and output circuits, a CPU and the like (none of which are shown).

The overall controller 124 determines final command values for the shift motors 100A, 100B and throttle motors 60A, 60B, based on the command values for the shift motors 100A, 100B and throttle motors 60A, 60B determined by the shift/throttle controller 120 and the outputs Dw, Vw of the anemometer 116. The overall controller 124 controls the operation of the shift motors 100A, 100B and throttle motors 60A, 60B based on the determined final command values to regulate the throttle openings and shift positions of the outboard motors 12A, 12B.

The overall controller 124 determines final command values for the steering motors 44A, 44B based on the command values for the steering motors 44A, 44B determined by the steering controller 122 and the outputs Dw, Vw of the anemometer 116 and controls the operation of the steering motors 44A, 44B based on the determined final command values to regulate the steering angles of the outboard motors 12A, 12B.

The final command values determined by the overall controller 124 are inputted to shift drivers 130A, 130B, steering drivers 132A, 132B and throttle drivers 134A, 134B installed in the outboard motors 12A, 12B, through a wire or wireless communication unit 126. These drivers operate the corresponding electric motors in response to the inputted final command values.

Specifically, the final command value for the shift motor 100A is inputted to the shift driver 130A of the first outboard motor 12A and the final command value for the shift motor 100B is inputted to the shift driver 130B of the second outboard motor 12B. The shift drivers 130A, 130B operate the shift motors 100A, 100B in response to the inputted final command values. As a result, the shift clutches 88A, 88B of the outboard motors 12A, 12B are driven to regulate the shift (gear) positions of the outboard motors.

The final command value for the steering motor 44A is inputted to the steering driver 132A of the first outboard motor 12A and the final command value for the steering motor 44B is inputted to the steering driver 132B of the second outboard motor 12B. The steering drivers 132A, 132B operate the steering motors 44A, 44B in response to the inputted final command values. As a result, the swivel shafts 36A, 36B of the outboard motors 12A, 12B are rotated to regulate the steering angles of the outboard motors.

The final command value for the throttle motor 60A is inputted to the throttle driver 134A of the first outboard motor 12A and the final command value for the throttle motor 60B is inputted to the throttle driver 134B of the second outboard motor 12B. The throttle drivers 134A, 134B operate the throttle motors 60A, 60B in response to the inputted final command values. As a result, the throttle valves 58A, 58B of the outboard motors 12A, 12B are opened/closed to regulate the speeds of the engines 50A, 50B (regulate the magnitude of the thrusts produced by the outboard motors 12A, 12B).

Thus the motors 44A, 44B, 60A, 60B, 100A and 100B are arranged such that they are all independently controlled. In other words, the steering angles, throttle openings and shift positions of the outboard motors 12A, 12B can all be independently regulated.

Figure 4:
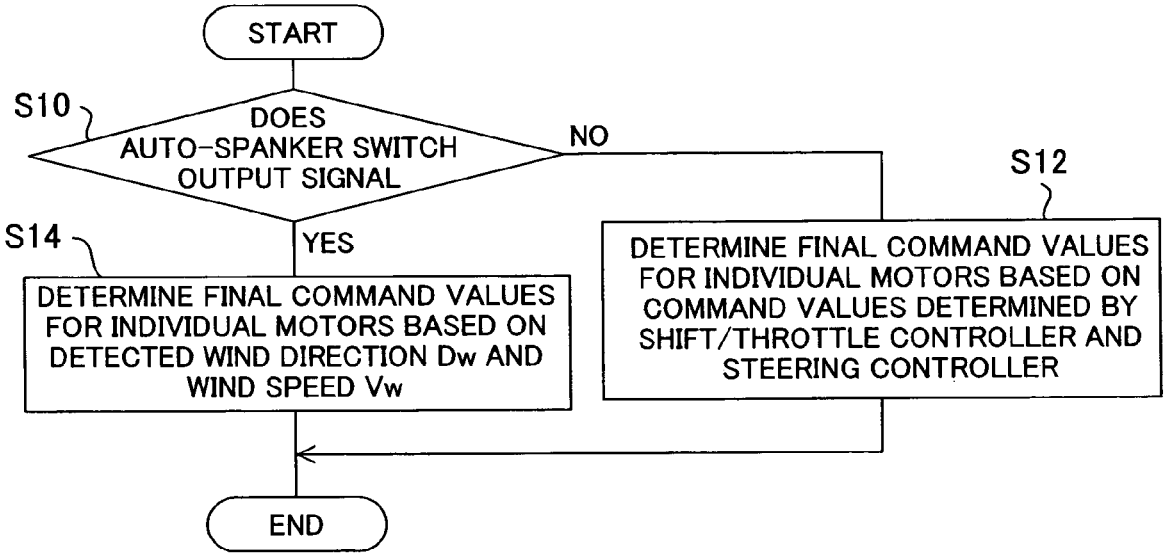
FIG. 4 is a flowchart showing the processing for determining final command values performed by an overall controller shown in FIG. 1.

The processing performed by the overall controller 124 for determining the final command values will now be explained. FIG. 4 is a flowchart showing the processing. The illustrated program is executed in the overall controller 124 at prescribed time intervals.

First, in S10, it is determined whether the auto-spanker switch 26 outputs a signal representing the auto-spanker control execute command.

When the result in S10 is NO, the program goes to S12, in which the final command values for the motors 44A, 44B, 60A, 60B, 100A and 100B of the outboard motors 12A, 12B are determined based on the command values determined by the shift/throttle controller 120 and steering controller 122.

Figure 5:
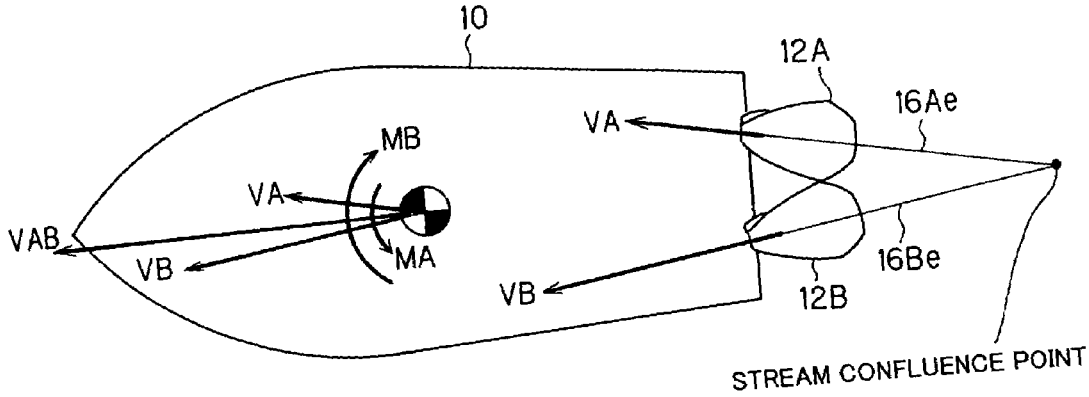
FIG. 5 is an explanatory view showing the magnitude and direction of thrusts produced by the outboard motors shown in FIG. 1.

FIG. 5 is an explanatory diagram showing the magnitude and direction of thrusts produced by the outboard motors 12A, 12B. The processing of S12 will be explained with reference to FIG. 5. In the following explanation, the term "stream confluence point" means the point of intersection between an extension of the axis of rotation of the propeller (propeller shaft) of the first outboard motor 12A (designated 16Ae in FIG. 5) and an extension of the axis of rotation of the propeller (propeller shaft) of the second outboard motor 12B (designated 16Be in FIG. 5).

As can be seen from FIG. 5, defining the vector representing the thrust produced by the first outboard motor 12A as VA and the vector representing the thrust produced by the second outboard motor 12B as VB, the angle between VA and VB depends on the stream confluence point (i.e., on the relative angle between the outboard motors 12A, 12B). The magnitudes of VA and VB, i.e., the magnitudes of the thrusts, depend on the throttle openings. The directions of VA and VB depend on the shift positions (i.e., the directions of VA and VB become contrary between the forward and reverse travel of the boat).

It is therefore possible by regulating the stream confluence point, throttle openings and shift positions, to regulate the magnitude and direction of the thrust acting at the center-of-gravity position of the boat 10 (the resultant of the vector VA and vector VB; expressed as vector VAB) and the moment about the vertical axis acting at the center-of-gravity position of the boat 10 (torque; the resultant of the moments MA and MB caused by the thrusts produced by the first and second outboard motors 12A, 12B). Since the first outboard motor 12A and second outboard motor 12B are not mechanically connected in the outboard motor control system according to this embodiment, their steering angles can be independently regulated to adjust the stream confluence point as desired.

Returning to the explanation of FIG. 4, in S12, the boat speed and turning radius desired by the operator are estimated or detected from the command values determined by the shift/throttle controller 120 and steering controller 122, and the optimum stream confluence point, throttle openings and shift positions are determined such that the estimated boat speed and turning radius are realized, while balancing the driving stability and turning performance. The stream confluence point is ordinarily positioned a predetermined distance (e.g., about 20 meters) rearward of the mounting location of the outboard motors 12A, 12B.

The steering angles of the outboard motors 12A, 12B are determined based on the determined stream confluence point. Specifically, the steering angles of the outboard motors 12A, 12B are independently determined so that the line 16Ae extending from the axis of rotation of the propeller of the first outboard motor 12A and the line 16Be extending from the axis of rotation of the propeller of the second outboard motor 12B intersect at the desired location (i.e., the determined stream confluence point).

The final command values for the motors 44A, 44B, 60A, 60B, 100A and 100B are determined based on the steering angles, throttle openings and shift positions determined in the foregoing manner and the determined final command values are sent to the drivers 130A, 130B, 132A, 132B, 134A and 134B to cooperatively operate the electric motors.

When the result in S10 is YES, i.e., when there has been an operator command to execute the auto-spanker control, the program goes to S14, in which the final command values for the motors 44A, 44B, 60A, 60B, 100A and 100B of the outboard motors 12A, 12B are determined based on the wind direction Dw and wind speed Vw detected by the anemometer 116. The operation of the motors 44A, 44B, 60A, 60B, 100A and 100B is then controlled based on the determined final command values to regulate the bow direction and position of the boat 10.

Specifically, the wind-induced thrust and moment acting on the boat 10 are determined or detected based on the wind direction Dw and wind speed Vw detected by the anemometer 116, and then the stream confluence point, throttle openings and shift positions are determined to produce a thrust and moment in the direction of canceling the estimated wind-induced thrust and moment to act at the center-of-gravity position of the boat 10. Further, the steering angles of the outboard motors 12A, 12B are determined based on the determined stream confluence point.

The final command values for the motors 44A, 44B, 60A, 60B, 100A and 100B are determined in accordance with the determined steering angles, throttle openings and shift positions, and the determined final command values are sent to the drivers 130A, 130B, 132A, 132B, 134A and 134B to cooperatively operate the electric motors.

As explained in the foregoing, the outboard motor control system according to this embodiment enables the steering angles of the outboard motors 12A, 12B to be independently regulated as desired. Therefore, as shown by way of example in FIG. 6, the stream confluence point can also be positioned forward of the mounting location of the outboard motors 12A, 12B. In addition, the throttle opening and shift position of each of the outboard motors 12A, 12B can be independently regulated. As a result, the stream confluence point, throttle openings and shift positions can be appropriately determined to cooperatively control or operate the electric motors to make the desired thrust and moment act effectively at the center-of-gravity position of the boat 10, thereby markedly enhancing the performance of the outboard motor control system as an auto-spanker.

Figure 6:
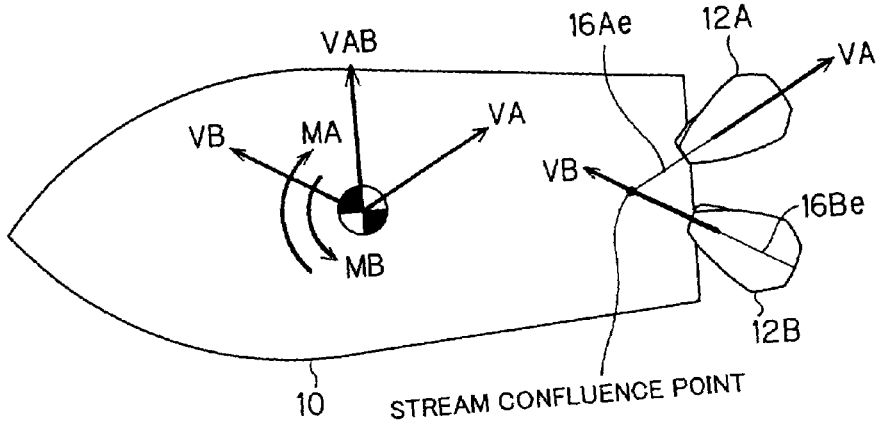
FIG. 6 is an other explanatory view similar to FIG. 5 showing the magnitude and direction of thrusts produced by the outboard motors shown in FIG. 1.
Figure 9:
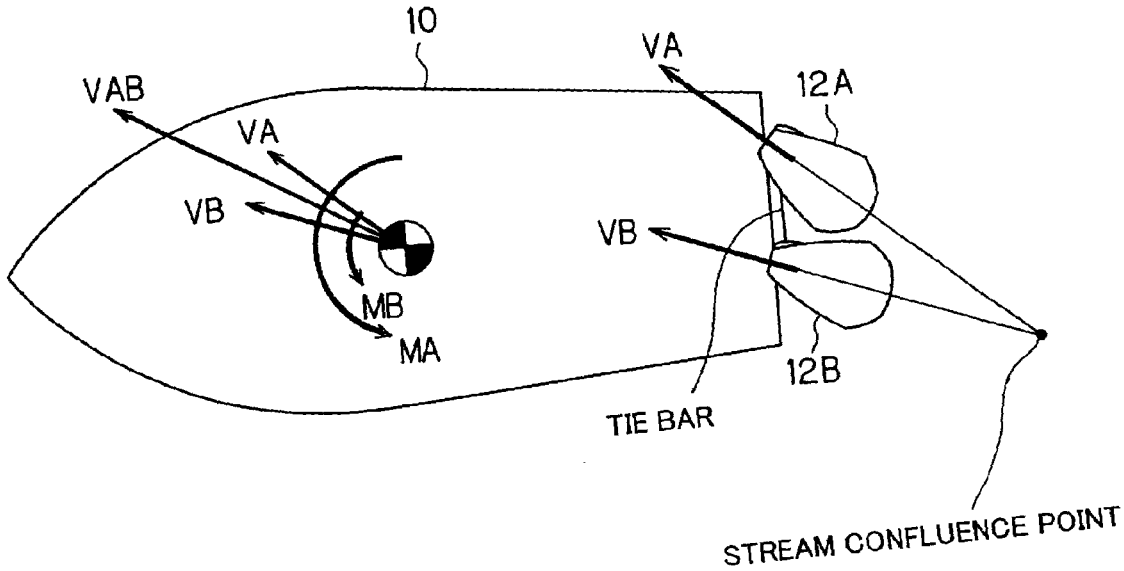
FIG. 9 is an explanatory view similar to FIG. 5 showing the magnitude and direction of thrusts produced by the outboard motors when they are steered with the use of the conventional outboard motor control system according to the prior art.

The diagram of FIG. 6 shows a case in which the outboard motors 12A, 12B are steered by the same angle in opposite directions and their propellers are rotated at the same speed in opposite directions. In the illustrated case, the forward thrust components produced by the outboard motors 12A, 12B are canceled out and moment acting on the boat 10 is also canceled, so that only thrust causing translational sideways movement (perpendicular to the forward direction) of the boat 10 acts on the boat. This enables the boat 10 to maintain its bow direction and position constant when the wind hits the boat abeam. In contrast, when the outboard motors are mechanically connected by a tie bar as in the prior art, the outboard motors are steered in the same direction so that when the propellers are rotated in opposite directions, all components of the thrusts are canceled out. Therefore, only thrust causing translational sidewise movement of the boat 10 cannot be easily obtained. (A case of conventional steering is shown in FIG. 9.)

Thus, the outboard motor control system according to the first embodiment of this invention is equipped in the two outboard motors 12A, 12B mounted on the boat 10 with the swivel shafts 36A, 36B that support the outboard motors 12A, 12B steerably with respect to the boat 10 and the steering motors 44A, 44B for driving the swivel shafts 36A, 36B, and the operation of the steering motors 44A, 44B is controlled to regulate the steering angles of the outboard motors 12A, 12B such that the lines 16Ae, 16Be extending from the axes of rotation of the propellers 16A, 16B propeller shafts) provided in the outboard motors 12A, 12B intersect at the desired point (desired stream confluence point). The stream confluence point of the outboard motors 12A, 12B of the multiple (two) motor installation on the boat 10 can therefore be freely adjusted to improve the boat driving stability of the boat 10 and enhance the performance of the outboard motor control system as an auto-spanker for automatically maintaining the bow direction and position of the boat 10 constant.

Moreover the outboard motors 12A, 12B are equipped with the throttle motors 60A, 60B for moving the throttle valves 58A, 58B of the engines 50A, 50B, the shift clutches 88A, 88B for transmitting the outputs of the engines 50A, 50B to the propellers 16A, 16B, and the shift motors 100A, 100B for driving the shift clutches 88A, 88B; the boat 10 is equipped with the anemometer 116 for detecting the wind direction Dw and wind speed Vw of the wind hitting the boat 10; and operation of the steering motors 44A, 44B, throttle motors 60A, 60B and shift motors 100A, 100B is controlled based on the detected wind direction Dw and wind speed Vw to regulate the bow direction and position of the boat 10. The performance of the outboard motor control system as an auto-spanker is therefore enhanced still further.

It is further possible to provide the outboard motors 12A, 12B with sensors for detecting the actual values of the steering angles, throttle openings, shift positions and the like, supply the detected values to the overall controller 124, and cause the overall controller 124 to take them into account when determining the final command values. In other words, the electric motors can be subjected to feedback control.

It is also possible to remove the shift/throttle controller 120 and steering controller 122 and send the outputs P1, P2 of the first and second lever position sensors 110, 112 and the output θstr of the rotation sensor 114 directly to the overall controller 124. In this case, the overall controller 124 determines the final command values for the electric motors based on the sensor outputs P1, P2 and θstr and the outputs Dw, Vw of the anemometer 116.

An outboard motor control system according to a second embodiment of this invention will now be explained.

Figure 7:
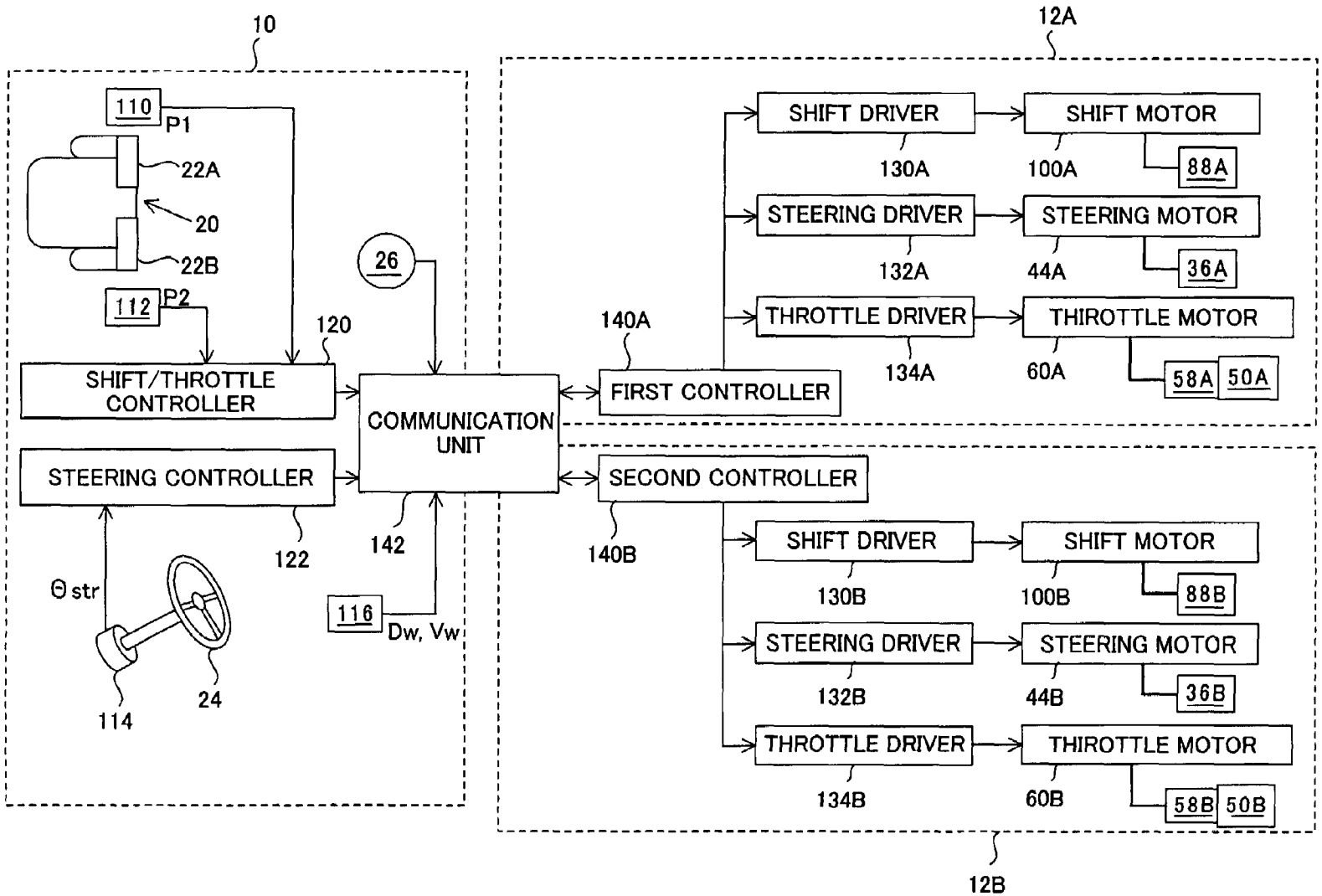
FIG. 7 is a block diagram, similar to FIG. 3, but showing an outboard motor control system according to a second embodiment of this invention.
Figure 8:
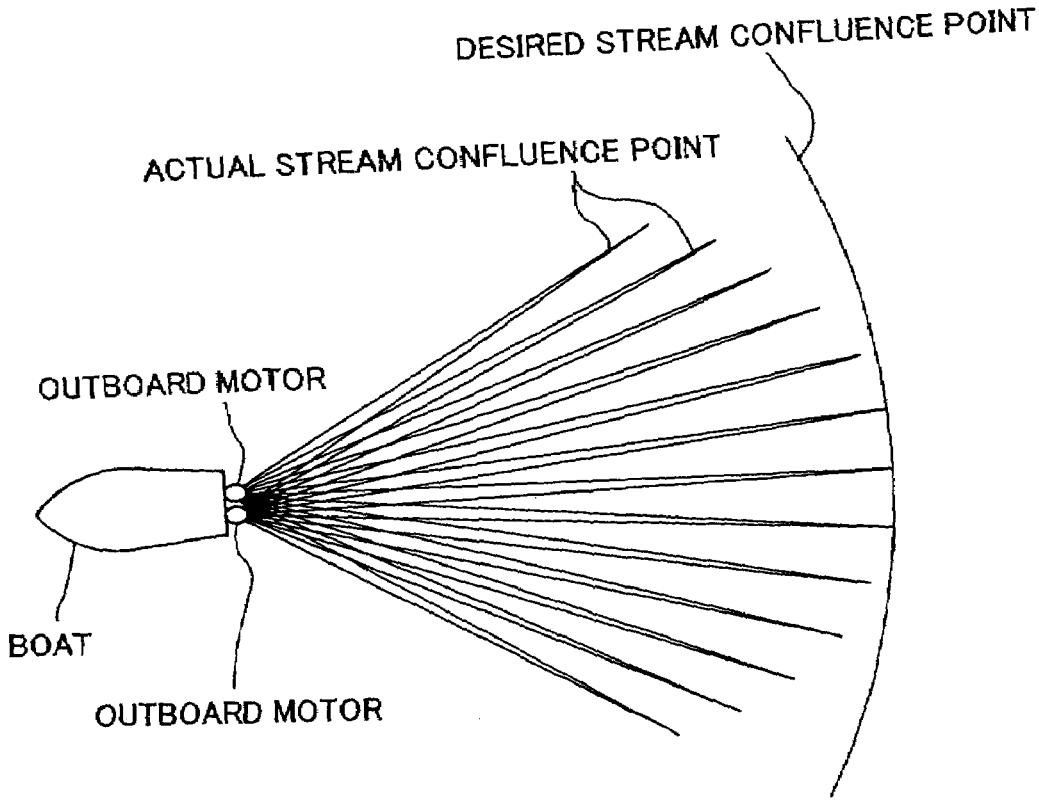
FIG. 8 is an explanatory view of a stream confluence point when outboard motors are steered with the use of a conventional outboard motor control system according to a prior art.

FIG. 7 is a block diagram, similar to FIG. 3, but showing the outboard motor control system according to the second embodiment of this invention.

The second embodiment will be explained with focus on the points of difference from the first embodiment. As shown in FIG. 7, in the second embodiment the overall controller 124 installed on the boat 10 is replaced with a first controller 140A installed in and used exclusively for controlling the first outboard motor 12A and a second controller 140B installed in and used exclusively for controlling the second outboard motor 12B.

The outputs P1, P2 of the first and second lever position sensors 110, 112, the output θstr of the rotation sensor 114, the outputs Dw, Vw of the anemometer 116 and the output of the auto-spanker switch 26 are inputted to the first and second controllers 140A, 140B via a wire or wireless communication unit 142. The first and second controllers 140A, 140B can also communicate and exchange information with each other via the communication unit 142.

The first and second controllers 140A, 140B perform only that part of the processing of the overall controller 124 explained with regard to the first embodiment that is related to the associated outboard motor in which it is installed. In other words, the first controller 140A installed in the first outboard motor 12A determines the command values (corresponding to the final command values of the first embodiment) for the steering motor 44A, throttle motor 60A and shift motor 100A and sends them to the drivers 130A, 132A and 134A.

The second controller 140B installed in the second outboard motor 12B determines the command values for the steering motor 44B, throttle motor 60B and shift motor 100B and sends them to the drivers 130B, 132B and 134B. The first and second controllers 140A, 140B share the command values (that they determine) by exchanging them via the communication unit 142.

The first and second controllers 140A, 140B determine the command values based the outputs P1, P2, θstr, Dw and Vw of the sensors 110, 112, 114 and 116, the output of the auto-spanker switch 26, and at least one motor command value determined in the other outboard motor.

Specifically, when the auto-spanker switch 26 does not output a signal representing the auto-spanker control execute command, the boat speed and turning radius desired by the operator are estimated or detected from the outputs P1, P2 and θstr of the sensors 110, 112 and 114 and one or more motor command values determined in the other outboard motor, and the optimum stream confluence point, throttle opening and shift position of the associated outboard motor are determined such that the estimated boat speed and turning radius are realized, while balancing the driving stability and turning performance.

The steering angle of the associated outboard motor is determined based on the determined stream confluence point. Specifically, the steering angle of the associated outboard motor is determined so that the line (one of 16Ae and 16Be) extending from the axis of rotation of the propeller of the associated outboard motor and the line (the other of 16Ae and 16Be) extending from the axis of rotation of the propeller of the other outboard motor intersect at the desired location (i.e., the determined stream confluence point).

The command values for the electric motors installed in the associated outboard motor are determined in accordance with the so-determined steering angle, throttle opening and shift position and the determined command values are sent to the drivers of the associated outboard motor to cooperatively operate or control the electric motors.

When the auto-spanker switch 26 outputs a signal representing the auto-spanker control execute command, the wind-induced thrust and moment acting on the boat 10 is estimated or detected from the outputs Dw, Vw of the anemometer 116, whereafter the stream confluence point and the throttle opening and shift position of the associated outboard motor are determined to produce a thrust and moment in the direction of canceling the estimated wind-induced thrust and moment to act at the center-of-gravity position of the boat 10. Further, the steering angle of the associated outboard motor is next determined based on the determined stream confluence point. Then the command values for the electric motors installed in the associated outboard motor are determined based on the steering angle, throttle opening and shift position determined for the associated outboard motor and the determined command values are sent to the drivers of the associated outboard motor to cooperatively control or operate the electric motors.

The structural features of the outboard motor control system according to the second embodiment are the same as those of outboard motor control system according to the first embodiment in other aspects and these will not be explained again here.

Thus, the outboard motor control system according to the second embodiment of this invention is removed with the overall controller 124 of the first embodiment but is instead equipped in the outboard motors 12A, 12B with the first and second controllers 140A, 140B that perform processing similar to that performed by the overall controller 124. Therefore, the outboard motor control system according to the second embodiment, like that according to the first embodiment, can freely adjust the stream confluence point of the outboard motors 12A, 12B of the multiple (two) motor installation on the boat 10, thereby improving the boat driving stability of the boat 10, and can also enhance the performance of outboard motor control system as an auto-spanker for automatically maintaining the bow direction and position of the boat 10 constant.

Moreover, the outboard motor control system according to the second embodiment is equipped with the communication unit 142 for enabling each outboard motor to exchange with the other the command values for the steering motors 44A, 44B, throttle motors 60A, 60B and shift motors 100A, 100B, and the first and second controllers 140A, 140B use the exchanged command values, the wind direction Dw and the wind speed Vw to control the operation of the steering motors 44A, 44B, throttle motors 60A, 60B and shift motors 100A, 110B. Therefore, even though the controllers for controlling the operation of the electric motors are provided separately for the outboard motors 12A, 12B, the stream confluence point can still be accurately regulated to the desired point, thereby improving the boat driving stability of the boat 10 and enhancing the performance of the outboard motor control system as an auto-spanker.

As stated above, the first embodiment is configured to have a system for controlling operation of a plurality of (two) outboard motors (12A, 12B) each supported on a stern of a boat (10) by a shaft (swivel shaft 36A, 36B) to be steerable relative to the boat and each having a propeller (16A, 16B) and a steering actuator (electric steering motor 44A, 44B) driving the shaft, comprising: a controller (overall controller 124, S12, S14) controlling operation of the steering actuators to regulate steering angles of the outboard motors such that lines (16Ae, 16Be) extending from axes of rotation of the propellers of the outboard motors intersect at a desired point.

In the system, each of the outboard motors includes: an internal combustion engine (50A, 508) connected to the propeller through a shift clutch (88A, 88B; a throttle actuator (electric throttle motor 60A, 60B) changing the opening of a throttle valve (58A, 58B) of the engine; and a shift actuator (electric shift motor 100A, 100B) driving the shift clutch to change a shift position; and further including: a sensor (anemometer or anemovane 116) detecting direction Dw and speed Vw of wind hitting the boat; and the controller controls operation of the associated steering actuator, associated ones of the throttle actuators and shift actuators based on the detected direction and speed of the wind to regulate bow direction and position of the boat.

In the system, the controller estimates wind-induced thrust and moment acting on the boat based on the detected direction and speed of the wind, determines a stream confluence point, the throttle opening and the shift position to produce thrust and moment in a direction of canceling the estimated wind-induced thrust and moment, and determines the steering angles based on the determined stream confluence point.

As stated above, the second embodiment is configured to have a system for controlling operation of a plurality of outboard motors (12A, 12B) each supported on a stern of a boat (10) by a shaft (swivel shaft 36A, 36) to be steerable relative to the boat and each having a propeller (16A, 168) and a steering actuator (electric steering motor 44A, 44B) driving the shaft, comprising: a plurality of controllers (first controller 140A, second controller 1408) each controlling operation of an associated one of steering actuators to regulate steering angles of the outboard motors such that lines (l6Ae, l6Be) extending from axes of rotation of the propellers of the outboard motors intersect at a desired point.

In the system, each of the outboard motors includes: an internal combustion engine (50A, 508) connected to the propeller through a shift clutch (88A, 88B); a throttle actuator (electric throttle motor 60A, 60B) changing opening of a throttle valve (58A, 58B) of the engine; and a shift actuator (electric shift motor 100A, 100B) driving the shift clutch to change a shift position; and further including: a sensor (anemometer or anemovane 116) detecting direction Dw and speed Vw of wind hitting the boat; and the controller controls operation of the associated steering actuator, associated ones of the throttle actuators and shift actuators based on the detected direction and speed of the wind to regulate bow direction and position of the boat.

In the system, the controller estimates wind-induced thrust and moment acting on the boat based on the detected direction and speed of the wind, determines a stream confluence point, the throttle opening and the shift position to produce thrust and moment in a direction of canceling the estimated wind-induced thrust and moment, and determines the steering angles based on the determined stream confluence point.

The system further includes: a communication unit (142) enabling the controllers to communicate with each other to exchange command values for the steering actuators, the throttle actuators and the shift actuators, and the controller controls operation of the associated steering actuator, the throttle actuator and the shift actuator based on the detected direction and speed of the wind and the command values for those of other than the associated actuators to regulate bow direction and position of the boat.

Although the first and second embodiments are explained with reference to multiple outboard motor installations comprising two outboard motors mounted on the boat 10, the invention can also be applied to multiple outboard motor installations comprising three or more outboard motors.

Although electric motors are exemplified for use as the steering actuators, throttle actuators and shift actuators in the foregoing description, it is possible instead to utilize hydraulic cylinders or any of various other kinds of actuators.

Japanese Patent Application No. 2004-332327 filed on Nov. 16, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling operation of a plurality of outboard motors each adapted to be supported on a stern of a boat by a shaft to be steerable relative to the boat and each having a propeller and a steering actuator driving the shaft, an internal combustion engine connected to the propeller through a shift clutch;

a throttle actuator changing an opening of a throttle valve of the engine; and a shift actuator driving the shift clutch to change a shift position; said system comprising:

a plurality of controllers each controlling operation of an associated one of steering actuators to regulate steering angles of the outboard motors such that lines extending from axes of rotation of the propellers of the outboard motors intersect at a desired point;

a sensor detecting direction and speed of wind hitting the boat; and a communication unit enabling the controllers to communicate with each other to exchange command values for the steering actuators, the throttle actuators and the shift actuators;

wherein each of the controllers determines the command values of the associated steering actuator, throttle actuator and shift actuator to control the operation of the associated steering actuator, throttle actuator and shift actuator based on the detected direction and speed of the wind and the command values for those of other than the associated actuators to regulate bow direction and position of the boat.

2. The system according to claim 1, wherein each of the controllers estimates wind-induced thrust and moment acting on the boat based on the detected direction and speed of the wind, determines a stream confluence point, the throttle opening and the shift position to produce thrust and moment in a direction of canceling the estimated wind-induced thrust and moment, and determines the steering angles based on the determined stream confluence point.

3. An outboard motor control system comprising:

a plurality of outboard motors, wherein each outboard motor is adapted to be supported on a stern of a boat by a shaft to be steerable relative to the boat and each outboard motor has a propeller and an independently operable steering actuator driving the shaft, each outboard motor comprising:

an internal combustion engine connected to the propeller through a shift clutch;

a throttle actuator changing an opening of a throttle valve of the engine; and a shift actuator driving the shift clutch to change a shift position;

a remote control box equipped with a first and a second lever to be manipulated by an operator;

a first lever position sensor which produces an output corresponding to the position of the first lever;

a second lever position sensor which produces an output corresponding to the position of the second lever;

a throttle controller for determining command values of the shift actuators based on an output of the first and second lever position sensors and for determining the command values for the throttle actuators based on the movement of the first and second levers;

a steering controller to regulate steering angles of the outboard motors such that lines extending from axes of rotation of the propellers of the outboard motors intersect at a desired point;

a wind sensor detecting direction and speed of wind hitting the boat;

a communication unit enabling the controllers to communicate with each other to exchange command values for the steering actuators, the throttle actuators and the shift actuators; and an overall controller which estimates wind-induced thrust and moment acting on the boat based on the detected direction and speed of the wind, determines a stream of confluence point, the throttle opening and the shift position to produce thrust and moment in a direction of canceling the estimated wind-induced thrust and moment, and determines the steering angles based on the determined stream confluence point, wherein an output of the throttle controller and an output of the steering controller are inputted and the overall controller which then determines the final command values of the associated steering actuator, throttle actuator and shift actuator to control operation of each motor based on the detected direction and speed of the wind and the command values for those actuators other than the associated actuators to regulate bow direction and position of the boat, and wherein the final command values determined by the overall controller are inputted to the associated steering actuator, throttle actuator, and shift actuator through the communication unit.

4. The outboard motor control system of claim 3, wherein the communication unit is a wireless communication unit.

* * * * *